US007130737B2

(12) United States Patent
Biester et al.

(10) Patent No.: US 7,130,737 B2
(45) Date of Patent: Oct. 31, 2006

(54) METHOD OF CONTROLLING A DRIVE UNIT OF A MOTOR VEHICLE

(75) Inventors: Juergen Biester, Boeblingen (DE); Thomas Glasstetter, Kraital-Oberoewisheim (DE); Ruprecht Anz, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/820,379

(22) Filed: Apr. 7, 2004

(65) Prior Publication Data

US 2004/0257016 A1 Dec. 23, 2004

(30) Foreign Application Priority Data

Apr. 7, 2003 (DE) ..... 103 16 016

(51) Int. Cl.
*F02D 45/00* (2006.01)

(52) U.S. Cl. ..... 701/110; 701/84

(58) Field of Classification Search ..... 701/110, 701/71–90, 111, 114; 123/320, 325, 330, 123/406.25, 406.23, 319, 395; 180/197
See application file for complete search history.

(56) References Cited

U.S. PATENT DOCUMENTS 6,065,446 A * 5/2000 Engl et al. ..... 123/325
6,584,399 B1 * 6/2003 Koibuchi ..... 701/90
6,799,113 B1 * 9/2004 Denz et al. ..... 701/110

* cited by examiner

*Primary Examiner*—Andrew M. Dolinar
*Assistant Examiner*—Johnny H. Hoang
(74) *Attorney, Agent, or Firm*—Kenyon & Kenyon LLP

(57) ABSTRACT

A method for controlling a drive unit of a vehicle which allows a comfortable compensation of the torque requirement of ancillary components. In this method, torque losses are compensated in a steady-state manner in an overrun and an acceleration operation. The steady-state compensation of the torque losses in overrun operation is weighted by a first weighting factor. The first weighting factor is raised in a linear manner when the drag torque decreases in amount, until acceleration operation is reached.

21 Claims, 4 Drawing Sheets

METHOD OF CONTROLLING A DRIVE UNIT OF A MOTOR VEHICLE

CROSS-REFERENCE TO RELATED APPLICATIONS

The present application claims priority to German Patent Application No. 103 16 016.7 filed on Apr. 7, 2003, which is expressly incorporated herewith.

FIELD OF THE INVENTION

The present invention relates to a method for controlling a drive unit of a motor vehicle.

BACKGROUND INFORMATION

Conventionally, torque losses of ancillary components are compensated, for instance, in steady-state in overrun and in acceleration operation of the drive unit.

SUMMARY

An example method according to the present invention, may have the advantage that the static (steady-state) compensation of the torque losses is weighted by a first weighting factor in overrun operation and that, in response to an increase in the amount of the drag torque, the first weighting factor is linearly increased until acceleration operation is reached. In this manner, a full static compensation may be realized in acceleration operation when the first weighting factor assumes the value one upon attaining acceleration operation. If during overrun operation the first weighting factor drops down to zero in a linear manner until a maximally possible drag-torque amount is reached, a vehicle-speed controller may be used to optimum effect in overrun operation as well, without this resulting in a constantly alternating energizing and de-energizing of ancillary components to realize a deceleration request on the part of the vehicle-speed controller. This increases driving comfort.

It may be particularly advantageous if the first weighting factor is derived from the sum of a torque requested by an idle-speed controller and a driver-desired torque, by relating this sum to the drag torque and restricting the generated quotient, preferably to a value between 0 and 1 . This may provide an especially simple possibility for determining the first weighting factor.

This also applies if the first weighting factor is derived from the sum of a torque requested by an idle-speed controller and a torque requested by a vehicle-speed controller, by relating this sum to the drag torque and restricting the generated quotient, preferably to a value between 0 and 1.

Furthermore, when generating a setpoint torque, it may be particularly advantageous if the drag torque is added to the driver-desired torque in a proportional manner as a function of a driving-pedal position, and if the first weighting factor is generated by relating the torque-request of an idle-speed controller to the drag torque and restricting this quotient, preferably to a value between 0 and 1, as well as limiting it by a second weighting factor by means of minimum selection. In this way, it may be possible to take a precompensation of the torque losses into account and to avoid an overcompensation of the torque losses.

This consideration of the precompensation may be accomplished in a simple manner in that the second weighting factor is generated by relating the driver-desired torque or the torque requested by a vehicle-speed controller to the drag torque, by restricting this quotient, preferably to a value between 0 and 1, and subtracting the restricted value from a setpoint value, preferably, one.

An additional advantage is that the restricted value is used as third weighting factor for a setpoint torque requested by the vehicle-speed controller, within the framework of a torque coordination with a setpoint-torque request derived from the driver-desired torque. This ensures that the precompensation of the torque losses is taken into account in the torque coordination.

It may also be advantageous if the portion of the torque losses that is to be statically compensated in acceleration operation is determined by a first factor. In this way, it is also possible to realize a static partial compensation of the torque losses in acceleration operation.

It is also advantageous if the portion of the torque losses that is to be compensated in overrun operation in a dynamic manner, given a maximum deceleration request, is determined by a second factor. This makes it possible to realize a dynamic compensation of the torque losses, so that an actuation jerk is avoided when ancillary components are switched on or off.

An additional advantage results if the portion of the torque losses that is to be statically and dynamically compensated in acceleration operation is determined by a third factor. In this manner, the static and dynamic compensation of the torque losses may be adjusted in acceleration operation as desired.

It is particularly advantageous in this context if the torque losses to be compensated are at least partially compensated in a dynamic and stationary manner as a function of the three factors and the first weighting factor. The compensation of the torque losses in acceleration and in overrun operation may then be adjusted as desired.

Moreover, it may be advantageous if a fourth factor is considered in the compensation, this factor indicating which portion of the torque losses has already been compensated in advance in a static manner. This prevents an over-compensation of the torque losses.

BRIEF DESCRIPTION OF THE DRAWINGS

Exemplary embodiments of the present invention are shown in the figures and explained in greater detail in the following description.

DESCRIPTION OF EXEMPLARY EMBODIMENTS

Figure 1:
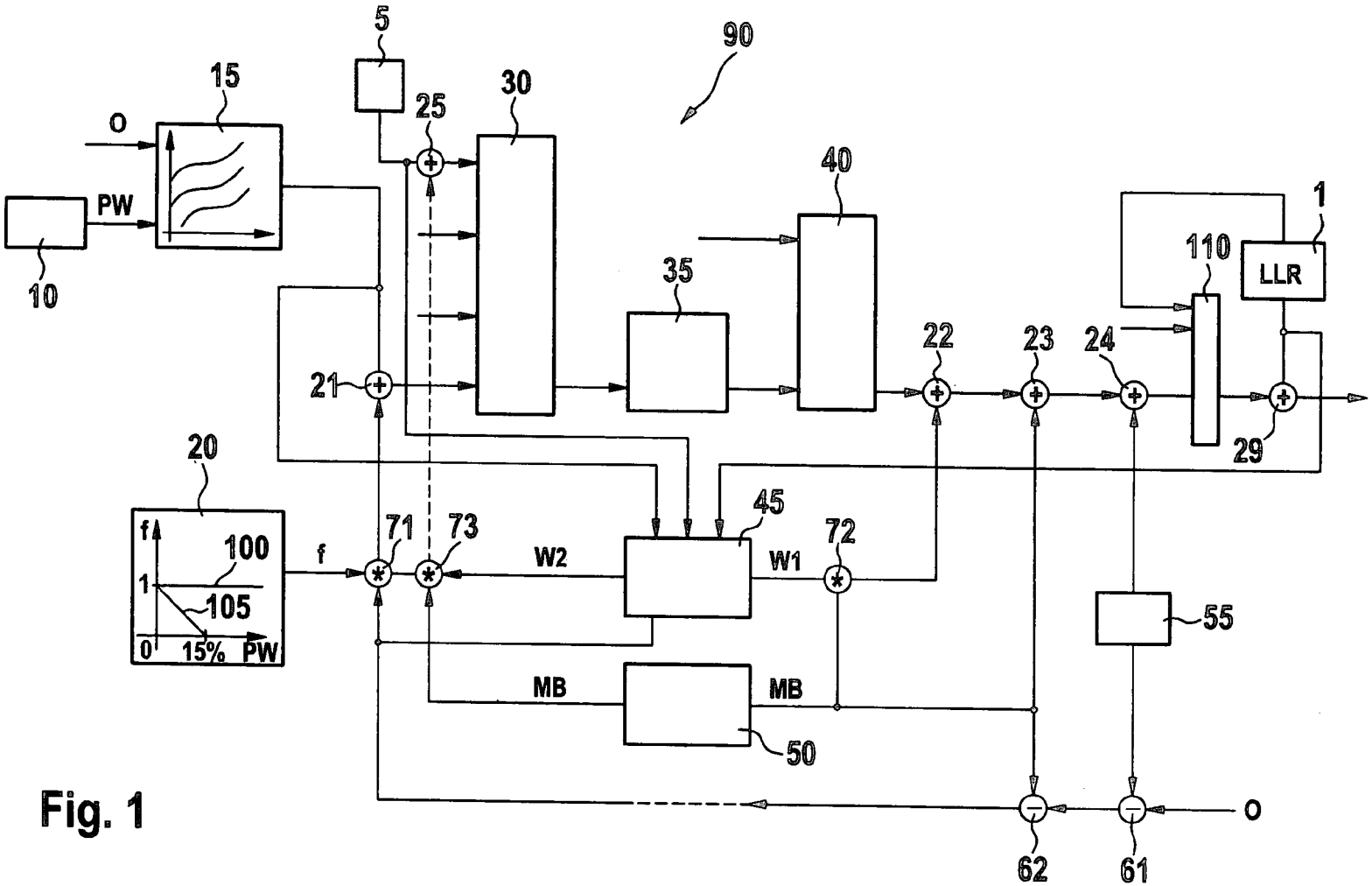
FIG. 1 shows a flow chart for determining an internal torque to be set by the drive unit or the engine.

Reference numeral 90 in FIG. 1 denotes a control of a drive unit of a motor vehicle that includes, for example, an internal combustion engine, which may be designed as a spark-ignition engine or diesel engine. Control 90 determines the torque to be generated by the drive unit. The determination of actuating variables for converting the torque to be generated is implemented in a conventional manner. Depending on the type of engine, these actuating variables may be the ignition firing point, the quantity of the fuel to be injected or the air supply, for instance. In this case, control 90 thus describes the torque structure of the drive unit of the motor vehicle.

A driver-desired torque is determined from an applicable characteristics map 15 as a function of vehicle speed v and an activation degree PW of a driving pedal 10 of the engine. The driver-desired torque is a wheel-output torque or transmission-output torque. Vehicle speed v may be determined in a conventional manner by a speed sensor, for instance. As an alternative, the driver-desired torque may also be ascertained from an applicable characteristics map as a function of engine speed n and activation degree PW. The use of the speed-dependent characteristics map 15 has the advantage, however, that the driver-desired torque is able to be determined independently of the instantaneously engaged gear.

The driver-desired torque determined in this manner is transmitted to a first summing element 21. Furthermore, a characteristics curve 20 is provided, which determines a weighting factor f as a function of activation degree PW of driving pedal 10. According to a dashed first profile 100, the weighting factor amounts to f=1 across all activation degrees PW. According to a second profile 105, weighting factor f has the value one at activation degree PW=O and drops linearly, up to zero, until an activation degree PW is reached that is equal to 15 degrees. For activation degrees PW that are greater than 15 percent, weighting factor f=0 . The transition from overrun operation to acceleration operation generally occurs at activation degree PW=15 percent, i.e., the amount of the driver-desired torque corresponds approximately to the drag torque. Furthermore, the majority of switching processes takes place at activation degrees PW that are greater than 15 percent.

Weighting factor f is supplied to a first multiplication member 71 where it is multiplied by a minimum propulsion torque. The minimum propulsion torque corresponds to the drag torque. The product generated at first multiplication member 71 is transmitted to first summing element 21 as well, where it is added there to the driver-desired torque. The generated sum is transmitted, as setpoint-torque request, to a coordinator 30 for the transmission-output torque of the drive unit. Moreover, a vehicle-speed controller 5 is provided in FIG. 1, which, if appropriate, transmits a setpoint-torque request to coordinator 30 for the transmission-output torque, using a fifth summing element 25. Additional arrows in FIG. 1 indicate that other vehicle functions, such as an anti-block system, a traction control system or an electronic stability program, may also transmit setpoint-torque requests to coordinator 30 for the transmission-output torque.

In a conventional manner, coordinator 30 determines a first resulting setpoint torque for the transmission output as a function of the priority and magnitude of the transmitted setpoint-torque requests. The first resulting setpoint torque is transmitted to a block 35 in which the gear ratio, the transformer amplification and losses of the transmission and the transformer are taken into account in a conventional manner, so that a second resulting setpoint torque is available at the output of block 35. This is conveyed to a coordinator 40 for the transmission-input torque and coordinated there with additional setpoint-torque requests of the transmission of the vehicle, in a conventional manner.

As a function of the priority and magnitude of the setpoint-torque requests transmitted to coordinator 40, or the transmitted second resulting setpoint torque, coordinator 40 determines a third resulting setpoint torque for the transmission input, in a conventional manner. This is transmitted to a second summing element 22. Moreover, control 90 includes a weighting unit 45, which determines a first weighting factor W1 according to the present invention and as described in the following, and transmits it to a second multiplication member 72.

Furthermore, a first detection unit 50 for torque losses of switched-in ancillary components, such as an air-condition system, car radio, etc., is provided, which determines torque requirement MB of the switched-in ancillary components, in a conventional manner, and likewise transmits this torque requirement, which corresponds to the torque losses of the ancillary components, to second multiplication member 72.

The product generated in this manner corresponds to the torque requirement of the ancillary components, weighted by first weighting factor W1. It is forwarded to second summing element 22, where it is added to the third resulting setpoint torque. The sum that is generated is transmitted to a third summing element 23 and added there to the torque requirement of the ancillary components determined by first detection unit 50. The sum generated in this manner is transmitted to a fourth summing element 24, where it is added to the torque losses of the engine determined by a second detection unit 55 in a conventional manner. These torque losses are the result of friction, for example. The sum available at the output of fourth summing element 24 is transmitted to a coordinator 110 for the engine torque and coordinated in coordinator 110 with additional setpoint-torque requests for the engine torque in a conventional manner. The additional setpoint-torque requests may come from an anti-judder function and/or an idle-speed controller 1, for example, and specify a limiting of the engine torque. A fourth resulting setpoint torque is then available at the output of coordinator 110 for the engine torque, which is transmitted to a ninth summing element 29 where it is added to the setpoint torque requested by idle-speed controller 1. This setpoint-torque request of idle-speed controller 1 may have its origin, for example, in the driving of a diesel engine having a sliding clutch, without activation of driving pedal 10.

The setpoint torque available at the output of ninth summing element 29 corresponds to the internal torque to be generated by the engine or the drive unit, which may be converted via the mentioned actuating variables. The torque losses of the engine determined by second detection unit 55 are subtracted from value 0 in a first subtraction element 61. The resulting difference is supplied to a second subtraction element 62.

In second subtraction element 62, the torque requirement of the ancillary components determined by first detection unit 50 are subtracted from this difference. The difference resulting at the output of second subtraction element 62 is transmitted to first multiplication member 71 as minimum propulsion torque, additional torque losses caused by the transmission and/or the converter having been deducted, if applicable.

Optionally, torque requirement MB of the ancillary components determined by first detection unit 50 may be transmitted to a third multiplication member 73 and multiplied there by a second weighting factor W2, which is likewise determined by weighting unit 45 according to the present invention.

The generated product is then conveyed to fifth summing element 25, where it is added to the setpoint torque requested by vehicle-speed controller 5. The generated sum is then transmitted as setpoint torque request of vehicle-speed controller 5, corrected by the torque requirement of the ancillary components, which is weighted by second weighting factor W2, to coordinator 30 for the transmission output torque. The torque requirement of the ancillary components, the torque losses of the engine and the torque losses attributable to the transmission and/or the converter are determined as positive values, so that the minimum propulsion torque is negative. Weighting unit 45 receives the driver-desired torque as output of characteristics map 15, the setpoint torque requested by vehicle-speed controller 5 as input of fifth summing element 25, the torque requested by idle-speed controller 1 and the minimum propulsion torque, i.e., the drag torque, as input of first multiplication element 71.

In those case where weighting factor f is selected according to first profile 100 and amounts to one for all activation degrees PW, or where weighting factor f is selected according to second profile 105 and the activation degree PW is equal to zero, that is, weighting factor f is also equal to one, the inclusion of the minimum propulsion torque in first summing element 21 does not constitute a compensation of the torque requirement of the ancillary components, the torque losses of the engine and the torque losses of the transmission and/or the converter, but merely a conversion into the internal torque required in order to realize the driver-desired torque at the transmission output or at the drive wheels. A compensation of the torque requirement of the ancillary components is then achieved by including the torque requirement of the ancillary components, weighted by first weighting factor W1, at second summing element 22.

Figure 2:
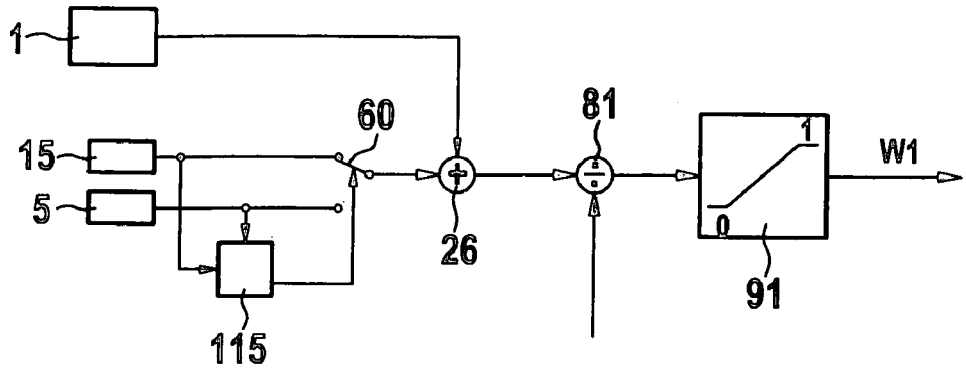
FIG. 2 shows a first flow chart for determining a first weighting factor.

The flow chart of FIG. 2 shows a first example of calculating first weighting factor W1 in weighting unit 45. The torque request of idle-speed controller 1 is transmitted to a sixth summing element 26 to which either the driver-desired torque of characteristics map 15 or the setpoint torque requested by the vehicle speed controller 5 is additionally transmitted as further input variable, via a first switch 60. First switch 60 is triggered by a first comparison element 115. Both the driver-desired torque of characteristics map 15 and the setpoint-torque request of vehicle speed controller 5 are transmitted to first comparison element 115.

First comparison element 115 compares the driver-desired torque to the setpoint torque requested by vehicle speed controller 5 and, if the driver-desired torque is smaller than the setpoint-torque requested by vehicle speed controller 5, connects the output of characteristics map 15 to sixth summing element 26 via first switch 60. If the driver-desired torque is greater than, or equal to, the setpoint torque requested by vehicle speed controller 5, it connects the output of vehicle speed controller 5, that is to say, the setpoint-torque request of vehicle speed controller 5, to sixth summing element 26. The sum of the torque request of idle-speed controller 1 and the driver-desired torque, or the setpoint-torque request of vehicle speed controller 5, is then available at the output of sixth summing element 26. This sum is divided in a first division element 81 by the amount of the drag torque, i.e., the minimum propulsion torque. The quotient generated in this manner is transmitted to a first limiter 91 and delimited to 0 in the downward direction and to 1 in the upward direction. First weighting factor W1, which may assume any value between 0 and 1, is then available at the output of first limiter 91. If the resulting torque of idle speed controller 1, vehicle speed controller 5 and driving pedal 10, or characteristics map 15, is equal to zero at the output of sixth summing element 26, for instance because both the torque requested by idle-speed controller 1 and the setpoint torque requested by vehicle speed controller 5 as well as the driver-desired torque are equal to zero, then first weighting factor W 1=0 as well, and no torque losses of the ancillary components, that is, no torque requirement of the ancillary components, is compensated. If the resulting torque at the output of sixth summing element 26 is greater than or equal to the amount of the drag torque, i.e., the amount of the minimum propulsion torque, then first weighting factor W1=1 . The amount of the drag torque is generated in weighting unit 45 from the supplied drag torque, in a conventional manner, using an amount generator, for instance.

Figure 4:
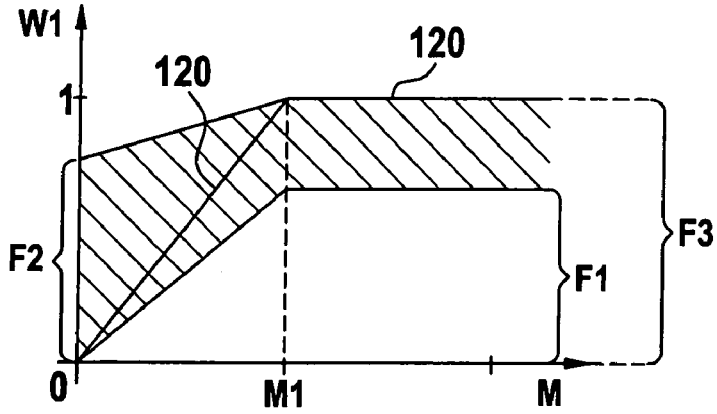
FIG. 4 shows a diagram to illustrate the first weighting factor over the torque.

FIG. 4 shows a diagram of first weighting factor W1 over resulting torque M at the output of sixth summing element 26. In a first torque M1, the transition from overrun operation to acceleration operation is present. For resulting torques that are smaller than first torque M1, overrun operation is present. For resulting torques that are greater than first torque M1, acceleration operation is present. At M=0, the drag torque is at its maximum amount. It is possible here for one or several cylinders of the internal combustion engine to be suppressed. When calculating first weighting factor W1 with the aid of the flow chart of FIG. 2, profile 120 of first weighting factor W1 ensues over resulting torque M. This rises from M=0 to M=M1 in a linear manner from 0 to 1, and then remains at 1 for M>M 1. Thus, a full static compensation of the torque requirement of the ancillary components results in acceleration operation, whereas, in overrun operation, the weighting of the torque requirement of the ancillary components decreases as the amount of the drag torque increases, so that only a static partial compensation of the torque requirement of the ancillary components takes place. This ensures that in an active vehicle speed control 5 no permanent energizing or de-energizing of one or a plurality of the ancillary components takes place during overrun operation for a braking action to be set. This increases the driving comfort. Consequently, the result for M=0 is that no steady-state compensation of the torque requirement of the ancillary components takes place if the driver, via driving pedal 10, vehicle-speed controller 5 and idle-speed controller 1 do not request a torque in order to maximally decelerate the vehicle using the drag torque.

If weighting factor f is determined according to second profile 105, it also includes value that are smaller than 1. This means that the driver-desired torque at first summing element 21 is no longer added to the complete drag torque and the torque requirement of the ancillary components is already compensated, at least partially, at the output of first summing element 21. In order to avoid overcompensation, it may be necessary to select first weighting factor W 1 to be smaller than 1.

Figure 3:
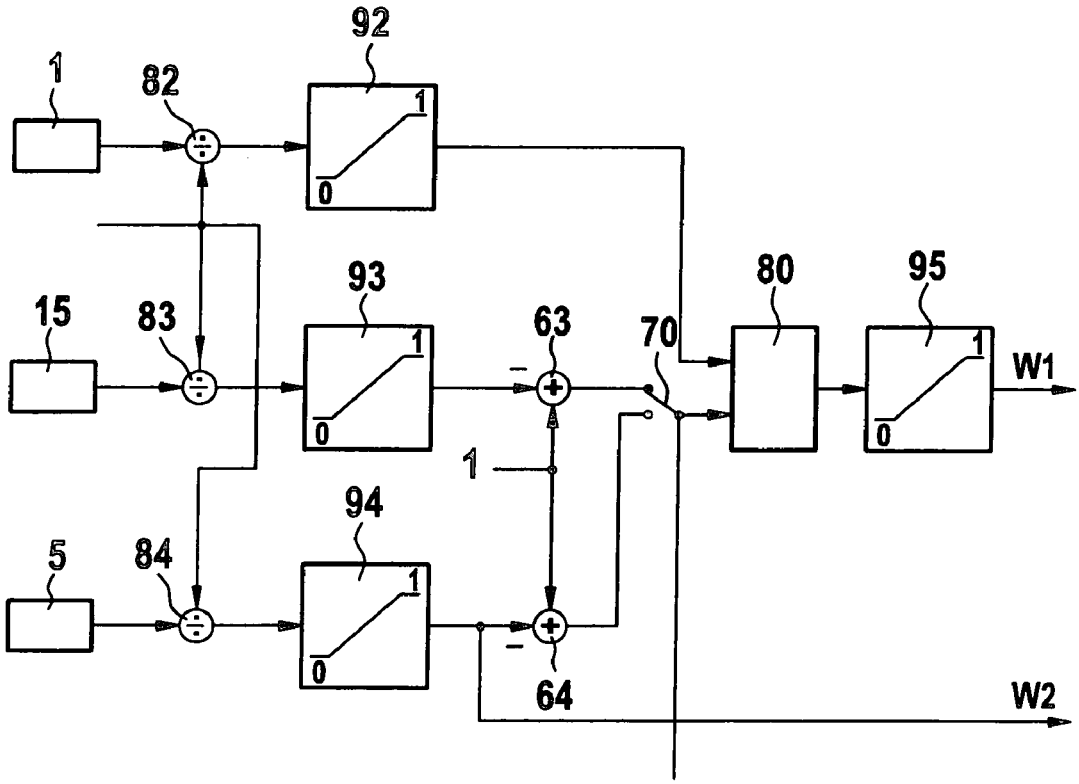
FIG. 3 shows a second flow chart for determining a first and a second weighting factor.

FIG. 3 shows a flow chart for determining first weighting factor W1, in this case, with the aid of weighting unit 45 according to a second example. In doing so, the torque request of idle-speed controller 1 is transmitted to a second division element 82, where it is divided by the amount of the drag torque. The quotient that is generated is supplied to a second limiter 92 und restricted there to the value O in the downward direction and to the value 1 in the upward direction. The output of second limiter 92 may thus assume any value between 0 and 1 and is transmitted to an input of a minimum-selection member 80. Furthermore, the output of characteristic 15 is transmitted to a third division member 83, where it is divided by the amount of the drag torque. The quotient that is formed is transmitted to a third limiter 93 und restricted there to the value O in the downward direction and to the value 1 in the upward direction. The output of third limiter 93 may thus assume any value between 0 and 1 and is transmitted to a third subtraction element 63, where it is subtracted from value 1. The difference generated may be transmitted to an additional input of minimum-selection member 80 via a second switch 70. Moreover, the output of vehicle-speed controller 5, that is, the setpoint torque requested by vehicle-speed controller 5, is transmitted to a fourth division element 84 and divided there by the amount of the drag torque. The quotient that is generated is transmitted to a fourth limiter 94 and restricted there to the value O in the downward direction and to the value 1 in the upward direction. The output of fourth limiter 94 may therefore assume any value between 0 and 1 and is transmitted to a fourth subtraction element 64, where it is subtracted from value 1. The difference generated may be transmitted to the additional input of minimum-selection member 80 via second switch 70. The output of fourth limiter 94 represents second weighting factor W2. Since in weighting factors f that are smaller than 1 the torque at the output of first summing element 21 may include, at least proportionally, torque losses of one or a plurality of ancillary components and is meant to be coordinated in coordinator 30 with a setpoint torque requested by vehicle-speed controller 5 that does not include portions of the torque losses of the ancillary components, this may lead to torque jumps. For this reason, according to the flow chart of FIG. 1, the setpoint torque requested by vehicle-speed controller 5 is corrected in fifth summing element 25 by the torque requirement of the ancillary components, which is in turn weighted by second weighting factor W2, which in turn simulates a weighting factor W1th respect to the setpoint torque requested vehicle-speed controller 5 relative to the amount of the drag torque.

At the instant when the torque desired by the driver and the setpoint torque requested by vehicle-speed controller 5 are identical in magnitude, that is, when a transition takes place from the setpoint-torque input by vehicle-speed controller 5 to the driver-desired torque, or from the driver-desired torque to vehicle-speed controller 5, the correction, at first summing element 21, of the driver-desired torque by the output of first multiplication member 71 corresponds to the correction of the setpoint torque requested by vehicle-speed controller 5 at fifth summing element 25 by the output of third multiplication member 73. Second switch 70 connects the output of third subtraction element 63 to the additional input of minimum-selection member 80 when the corrected setpoint-torque request at the output of fifth summing element 25 is greater than or equal to the driver-desired torque at the output of characteristics map 15. Otherwise, second switch 70 connects the output of fourth subtraction element 64 to the additional input of minimum-selection element 80. The variable transmitted to the additional input of minimum-selection member 80 may also be called a third weighting factor. Minimum-selection member 80 selects the minimum of its two input variables and transmits it to a fifth limiter 95, which restricts the output of minimum-selection element 80 to 0 as the minimum and to 1 as the maximum. The output of fifth limiter 95 may thus assume any value between 0 and 1 . It represents first weighting factor W1. In this case, first weighting factor W1 ensures that only that portion of the torque required by the ancillary components is added to the third resulting setpoint torque at second summing element 22 that has not yet been compensated in the setpoint-value path from first summing element 21 to second summing element 22. This is ensured by the minimum selection in minimum-selection element 80. This minimum selection restricts the weighting factor available at the output of limiter 92 to the portion of the torque requirement of the ancillary components that has not yet been compensated in the setpoint-value path from first summing element 21 to second summing element 22. This portion of the torque required by the ancillary components is thus tied to the torque requested by idle-speed controller 1, which is taken into account after second summing element 22. Up to second summing element 22, the torque requirement of the ancillary components had only been considered with respect to the driver-desired torque and the setpoint torque requested by vehicle-speed controller 5 in the setpoint path, but not with respect to the torque requested by idle-speed controller 1. The compensation of the torque requirement of the ancillary components with respect to the torque requested by idle-speed controller 1 is then implemented by correcting the third resulting setpoint torque in second summing element 22 by the output of second multiplication element 72. The output of second limiter 92 is 0 when idle-speed controller 1 is not activated. The output of second limiter 92 is 1 when the torque requested by idle-speed controller 1 is greater than, or equal to, the amount of the drag torque. However, if the torque requested by idle-speed controller 1 is greater than 0 and smaller than the amount of the drag torque, the output of second limiter 92 is between 0 and 1.

The method according to the present invention allows a variable coupling of the compensation of the torque requirement of the ancillary components to the various torque requesters, such as vehicle-speed controller 5, driving pedal 10, or characteristics map 15, and idle-speed controller 1. This means that, when one of the mentioned torque requesters is followed by one of the other torque requesters, for instance within the framework of the torque coordination in coordinator 30 or by activation or deactivation of idle-speed controller 1, no jumps occur in the compensation of the torque requirement of the ancillary components. At the same time, the method according to the present invention allows a physically correct representation of the internal torque to be generated by the engine or the drive unit.

It may be provided that one or several of the following portions be specified with the aid of one or a plurality of factors:

1 . the portion of the torque losses that is to be statically compensated, by a first factor F1, in acceleration operation, in which the propulsion torque to be generated by the drive unit is higher in its amount than the drag torque, that is, M is greater than M1 according to FIG. 4;

2 . the portion of the torque losses that is to be dynamically compensated, by a second factor F2 for M=0, in overrun operation, that is, when neither the driver, via driving pedal 10, nor vehicle-speed controller 5 or idle-speed controller 1 request a torque, and which is thus to be maximally decelerated, so as to prevent a switch-over or switch-on jerk during activation or deactivation of one or a plurality of ancillary components;

3 . the portion of the torque losses that is to be compensated, by a third factor F3, in acceleration operation in a dynamic and steady-state manner, the terms steady-state and static having the same meaning in this specification.

FIG. 4 shows the three factors F1, F2, F3. The range that is realized by dynamic compensation of the torque losses or the torque requirement of the ancillary components is shaded in FIG. 4. Although the two factors F1, F3 are specified in acceleration operation, they are valid across the entire torque range nevertheless, that is, they have an effect in overrun operation as well. The same holds for second factor F2, which is specified for M=0, but also holds across the entire torque range and thus has an effect in acceleration operation as well. A dynamic compensation in acceleration operation also results when first factor F1 is smaller than one.

Figure 7:
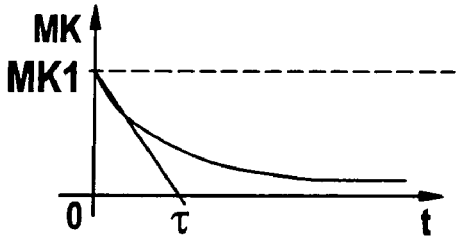
FIG. 7 shows a diagram of a compensating torque or a compensation torque over the time for a dynamic compensation of the torque requirement of ancillary components.

FIG. 7 shows a diagram in which a torque MK, which dynamically compensates the torque requirement of the ancillary components, is plotted over time t. At an instant t=0, the dynamically compensating torque MK jumps from zero to a value MK1 that is greater than 0, and subsequently drops exponentially to time constant $\tau$, to approach value 0 again in an asymptotical manner. As an alternative and in the event that M in FIG. 4 is greater than zero and both factors F1, F3 are likewise greater than zero, the dynamically compensating torque will over time asymptotically approach a steady-state compensating torque that is greater than zero. The dynamic compensation of the torque requirement of the ancillary components makes it possible to realize an energizing or de-energizing of one or a plurality of ancillary components in a jerk-free manner. The compensation of the torque requirement may subsequently be exponentially reduced without the driver noticing. An alternative, steady-state compensation of value MK1 is shown in FIG. 7 by a dashed line over time t, which has the constant value MK1.

The value range of the three factors F1, F2, F3 is in each case between, and inclusive of, zero and one, as can be inferred from FIG. 4. The three factors F1, F2, F3 may also be applied as desired in order to set the static or steady-state and the dynamic compensation of the torque losses in a suitable manner and in accordance with the driver's requirements.

Figure 5:
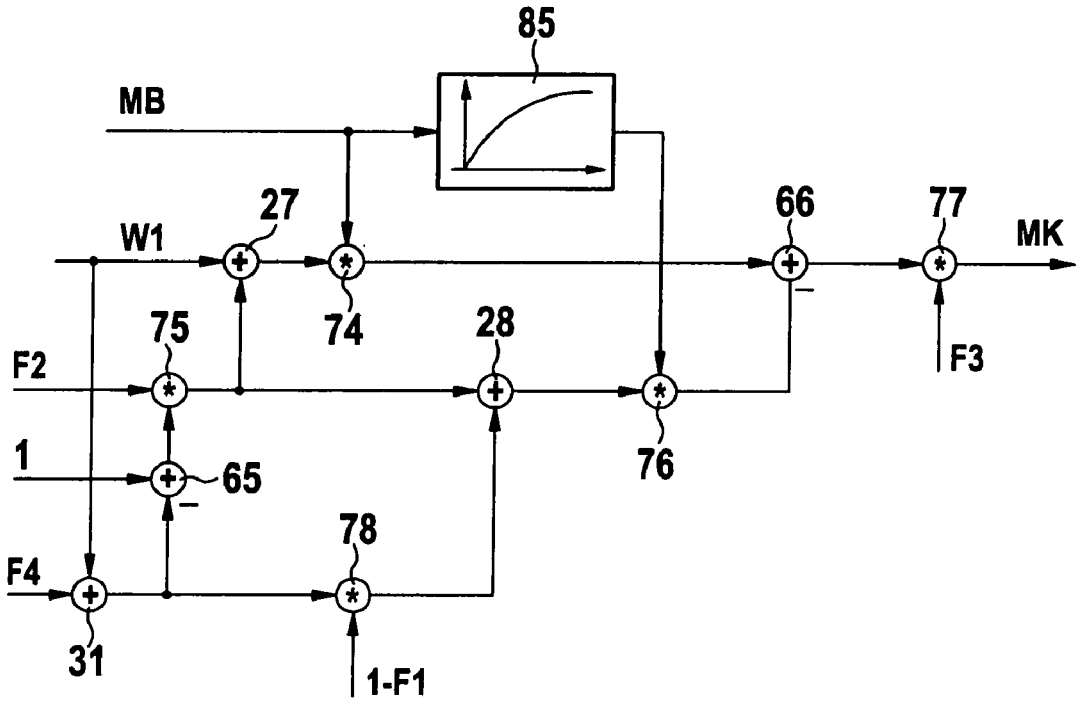
FIG. 5 shows a flow chart for a first example for determining a compensation torque for the torque losses of the ancillary components.

FIG. 5 shows a flow chart for determining compensating torque MK. This compensating torque MK, instead of being added to the output of second multiplication member 72, is added to the third resulting torque in second summing element 22. In the flow chart according to FIG. 5, a fourth factor F4 considers the portion of the torque losses of the ancillary components that has already been compensated in steady state in the signal path, or in the setpoint-value path, from first summing element 21 to second summing element 22. Fourth factor F4 corresponds to the portion of the torque losses of the ancillary components already compensated in steady state in the signal path, or in the setpoint-value path, from first summing element 21 to second summing element 22. This portion, and thus fourth factor F4, may also be zero if no torque losses were compensated in said signal path. According to FIG. 5, torque requirement MB of the ancillary components, which was determined by first detection unit 50, is transmitted to a fourth multiplication member 74, on the one hand, and to a proportional time member of the first degree, a so-called PT1 member 85, on the other hand, on the input side. The torque requirement of the ancillary components, filtered according to PT1 member 85, is transmitted to a sixth multiplication member 76. First weighting factor W1 is transmitted to a seventh summing element 27, on the one hand, and to a tenth summing member 31, on the other hand. In tenth summing member 31, first weighting factor W1 is added to fourth factor F4. The generated sum is deducted in a fifth subtraction member 65 from the value 1, on the one hand, and multiplied by factor 1-F1 in an eighth multiplication member 78, on the other hand. The difference at the output of fifth subtraction element 65 is multiplied in a fifth multiplication member 75 by second factor F2. The resulting product is added to first weighting factor W1 in seventh summing element 27. The sum that results is multiplied in fourth multiplication member 74 by the torque requirement of the ancillary components. In an eighth summing element 28, the output of fifth multiplication member 75 is added to the output of eighth multiplication member 78. The sum that is generated is multiplied in a sixth multiplication member 76 by the output of PT1 member 85. In a sixth subtraction element 66, the output of sixth multiplication member 76 is subtracted from the output of fourth multiplication member 74. The generated difference is multiplied by third factor F3 in seventh multiplication member 77. The product obtained in this manner is compensating torque MK, which generally has both a dynamic and a steady-state portion. If second factor F2=0, compensating torque MK has no dynamic portion. Otherwise, a dynamic portion will be present. The steady-state portion is present only when first factor F1 is greater than zero.

If only a completely steady-state compensation is intended, i.e., F2=0 and F1=1, the torque losses of the ancillary components are multiplied by first weighting factor W1 in fourth multiplication member 74 and nothing is subtracted at sixth subtraction element 66, i.e., the output of sixth subtraction element 66 corresponds to the output of fourth multiplication member 74. If a dynamic compensation is intended, i.e., 0<F2<=1 and/or 0<=F1<1, the portion of the torque losses that is to be compensated only dynamically is calculated in eighth summing element 28. This is multiplied in sixth multiplication member 76 by the torque requirements of the ancillary components, filtered by PT1 member 85, and subtracted in sixth subtraction element 66 from the torque losses of the ancillary components to be compensated in steady state, which is available at the output of fourth multiplication member 74. Compensating torque MK may also become negative, because the sum of fourth factor F4 and first weighting factor W1 is greater than, or equal to, first weighting factor W1.

If the torque requirement of the ancillary components is to be dynamically compensated only in overrun operation, i.e., F2>0 and W1<1 and F4<1, the corresponding portion of the torque losses of the ancillary components that is to be dynamically compensated is transmitted at the output of fifth multiplication member 75 both on the signal path for the steady-state compensation of the torque losses of the ancillary components, via seventh summing element 27, and also on the signal path for the dynamic compensation of the torque losses of the ancillary components, via eighth summing element 28. Due to the signal, acted upon by a PT1 behavior, at the output of sixth multiplication member 76, a signal having DTI behavior results at the output of sixth subtraction element 66, that is, a behavior according to a filtering by a differential-time element of the first order. This DT1 behavior is thus also characteristic for compensating torque MK at the output of seventh multiplication member 77. This dynamic portion turns into zero when the sum of first weighting factor W1 and fourth factor F4 assumes the value zero.

It may be ensured by the flow chart according to FIG. 5 that, especially in acceleration operation, the portion of those torque losses of the ancillary components, which is not wanted in the generation of compensating torque MK and which was already taken into account in the signal path from first summing element 21 to second summing element 22, is deducted in fifth subtraction element 65.

Figure 6:
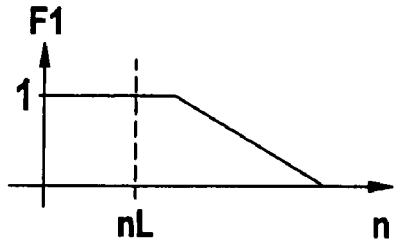
FIG. 6 shows a diagram of a first factor for the portion of the torque losses that is to be statically compensated in acceleration operation, above the rotational speed of the engine.

For engine speeds n that are much greater than the idling speed, first factor F1 may be reduced with rising engine speed. This increases the passive safety of the vehicle with respect to self-acceleration. However, in the range of idling speed, first factor F1 should not be a function of speed so as to avoid reciprocal actions with idle-speed controller 1. A possible profile of first factor F1 over engine speed n is shown in FIG. 6. In this contest, first factor F1 has the value one, from engine speed n=0 and to beyond idling speed nL, and then drops to zero in an approximately linear manner, for example, as engine speed n continues to increase.

Given appropriate adaptation, third factor F3 allows to compensate faults in determining the torque requirement of the ancillary components by first detection unit 50.

The present invention thus makes it possible that the compensation type of the torque requirement of the ancillary components is freely applicable to the greatest possible extent with the aid of the mentioned three factors F1, F2, F3. In this context, the compensation type of compensation means full compensation, partial compensation, steady-state or dynamic compensation. The application freedom of these three factors F1, F2, F3 is restricted by the requirement according to characteristic curve 120 of FIG. 4, according to which there is no steady-state compensation if the driver of driving pedal 10 does not select a driver-desired torque and vehicle-speed controller 5 and idle-speed controller 1 also do not request a torque so as to maximally decelerate the vehicle using the drag torque. However, a dynamic compensation of the torque losses of the ancillary components may also be useful for M=0, that is, when the cylinder of the engine is at least partially suppressed in order to compensate the activation jerk during activation or deactivation of ancillary components having a relatively large torque requirement. In acceleration operation, all variants are possible for the selection of the three factors F1, F2, F3. Due to the linearity of the profile of first weighting factor W1 in overrun operation, the transition from a purely dynamic compensation for M=0, i.e., when the cylinders of the engine are at least partially suppressed in overrun operation with maximum deceleration, to a selected variant of the steady-state and/or dynamic compensation in acceleration operation is continuous with appropriate selection of the three factors F1, F2, F3 is continuous.

Figure 8:
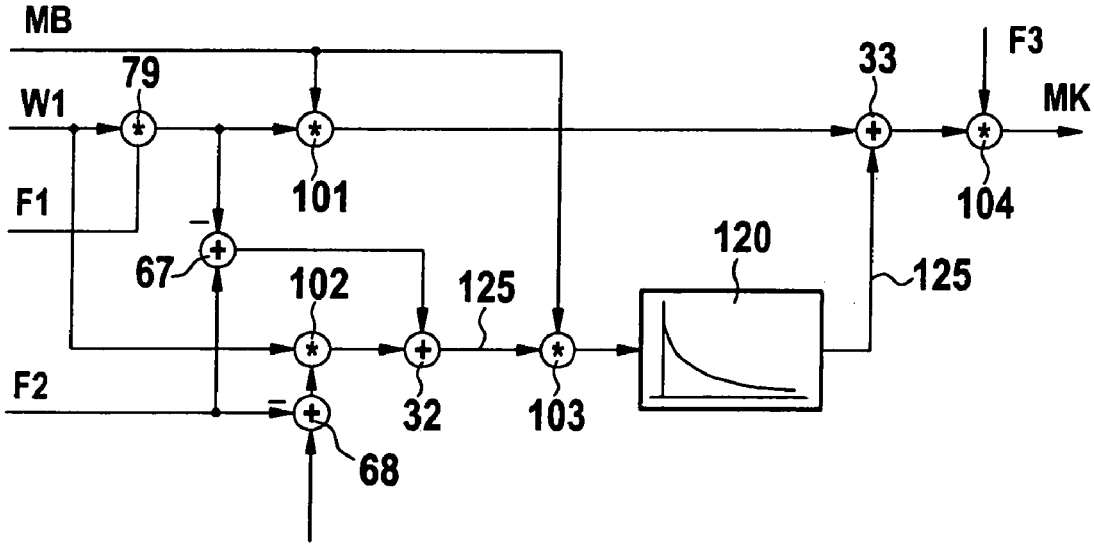
FIG. 8 shows a flow chart for a second example for determining a compensation torque for the torque losses of the ancillary components.

FIG. 8 shows a second example for determining compensating torque MK under the condition that fourth factor F4=0, that is, the portion of the torque losses of the ancillary components that was already compensated in a steady-state manner in the signal path from first summing element 21 to second summing element 22, is equal to zero. In the flow chart of FIG. 8, torque requirement MB of the ancillary components, determined by first detection unit 50, is transmitted to a tenth multiplication member 101, where it is multiplied by a product, generated in a ninth multiplication member 79, from first weighting factor W1 and first factor F1. The product generated is transmitted to a twelfth summing element 33 and added there to the output of a differential-time element of the first order, a so-called DT1 member 120. The sum that results is multiplied in a thirteenth multiplication member 104 by third factor F3 so as to generate compensating torque MK. The output of ninth multiplication member 79 is subtracted from second factor F2 in a seventh subtraction element 67. The difference that results is added to the output of an eleventh multiplication member 102 in an eleventh summing element 32. The generated sum is multiplied in a twelfth multiplication member 103 by torque requirement MB of the ancillary components. The resulting product is transmitted to DT1 member 120 on the intake side and subjected to appropriate filtering by DT1 member 120. The DT1-filtered signal at the output of DT1 member 120 is then transmitted to twelfth summing element 33 as described. In eleventh multiplication member 102, first weighting factor W1 is multiplied by the difference formed by subtracting second factor F2 from the value one, this difference being available at the output of an eighth subtraction element 68. The resulting product is transmitted to eleventh summing element 32 as described.

The method of the functioning of the flow chart of FIG. 8 is described in the following. Relative to first weighting factor W1, torque requirement MB of the ancillary components is compensated in a steady-state manner. The torque requirement of the ancillary components to be compensated in steady-state results from multiplication by the product from first weighting factor W1 and first factor F1 in tenth multiplication member 101. Second factor F2 indicates how large the portion of the torque losses of the ancillary components is that is to be dynamically compensated, when the driver, at driving pedal 10, vehicle-speed controller 5 and idle-speed controller 1 do not request a torque and want maximum deceleration, i.e., given at least partial suppression of the cylinders of the engine. In transitioning from this suppression, i.e., from M=0 to overrun operation at M>0, this portion is increased further and further, as can also be gathered from the shaded area in FIG. 4 for overrun operation, in that the stationary portion, i.e., the product from first weighting factor W1 and first factor F1, is deducted from second factor F2 in seventh subtraction element 67. If only a steady-state compensation is sought in acceleration operation, i.e., F1=W1=1, the value zero will always result at the output of eleventh summing element 32, so that dynamic path 125 of the flow chart according to FIG. 8 is inactive, or the dynamic portion of compensating torque MK is zero. If dynamic compensation is to take place in acceleration operation, the dynamic portion results from the difference of third factor F3 minus first factor F1.

According to the flow chart of FIG. 8, the dynamic and steady-state portions are separately multiplied by compensating torque requirement MB of the ancillary components that is to be compensated, the dynamic portion being filtered by DT1 member 120 and the dynamic and steady-state portions being added up.

What is claimed is:

1. A method for controlling a drive unit of a vehicle, comprising:

compensating in steady-state torque losses in an overrun and in an acceleration operation of the drive unit;

weighting a steady-state compensation of the torque losses by a first weighting factor in overrun operation; and linearly raising the first weighting factor when a drag torque decreases in amount, until traction operation is reached.

2. The method as recited in claim 1, further comprising:

deriving the first weighting factor from a sum of a torque requested by an idle-speed controller and a driver-requested torque;

relating the sum to the drag torque to provide a generated quotient; and restricting the generated quotient.

3. The method as recited in claim 2, wherein the generated quotient is restricted to a value between 0 and 1.

4. The method as recited in claim 1, further comprising:

deriving the first weighting factor from a sum of a torque requested by an idle-speed controller and a torque that is requested by a vehicle-speed controller;

relating to sum to the drag torque to provide a generated quotient; and restricting the generated quotient.

5. The method as recited in claim 4, wherein the generated quotient is restricted to a value between 0 and 1.

6. The method as recited in claim 1, further comprising:

generating a setpoint torque, including proportionally adding the drag torque to a driver-desired torque, as a function of a position of a driving pedal;

generating the first weighting factor including relating a torque requested by an idle-speed controller to a drag torque, to provide a quotient; and restricting the quotient.

7. The method as recited in claim 6, wherein the quotient is restricted to a value between 0 and 1.

8. The method as recited in claim 1, further comprising:

generating a setpoint torque including proportionally adding the drag torque to a driver-desired torque, as a function of a position of a driving pedal; and generating the first weighting factor by relating a torque requested by an idle-speed controller to the drag torque to provide a quotient;

restricting the quotient by a third weighting factor by minimum selection.

9. The method as recited in claim 8, wherein the quotient is restricted to a value between 0 and 1.

10. The method as recited in claim 8, further comprising:

forming the third weighting factor by relating the driver-desired torque to the drag torque to provide a generated quotient, restricting the generated quotient, and subtracting the restricted generated quotient from a setpoint value.

11. The method as recited in claim 10, wherein the generated quotient is restricted to a value between 0 and 1.

12. The method as recited in claim 10, wherein the setpoint value is one.

13. The method as recited in claim 8, further comprising:

forming the third weighting factor is formed by relating a torque requested by a vehicle-speed controller to the drag torque to provide a generated quotient, restricting the generated quotient, and subtracting the restricted generated quotient from a setpoint value.

14. The method as recited in claim 13, wherein the generated quotient is restricted to a value between 0 and 1.

15. The method as recited in claim 13, wherein the setpoint value is one.

16. The method as recited in claim 13, wherein the restricted generated quotient is used as second weighting factor for a setpoint-torque request of the vehicle-speed controller within a framework of a torque coordination with a setpoint-torque request derived from the driver-desired torque.

17. The method as recited in claim 1, further comprising:

determining a portion of the torque losses that is to be statically compensated in traction operation by a first factor.

18. The method as recited in claim 1, further comprising:

determining a portion of the torque losses that is to be dynamically compensated in overrun operation, given a maximum deceleration requested, by a second factor.

19. The method as recited in claim 1, further comprising:

determining a portion of the torque losses that is to be statically compensated and dynamically compensated, in traction operation, by a third factor.

20. The method as recited in 1, wherein torque losses to be compensated are at least one of dynamically and statically compensated, at least partially, as a function of three factors, and the first weighting factor.

21. The method as recited in claim 11, wherein a fourth factor is taken into account in the compensation, the fourth factor indicating which portion of the torque losses has already been compensated in advance in a steady-state manner.

* * * * *